United States Patent [19]

Genovese et al.

[11] Patent Number: 4,825,852

[45] Date of Patent: May 2, 1989

[54] CONTINUOUS PASSIVE MOTION DEVICE

[75] Inventors: Carmen E. Genovese, Encinitas; David B. Patch, San Diego; David A. Westerfield, San Diego; John T. Gross, San Diego; Christopher C. Dumas, Poway, all of Calif.

[73] Assignee: Sutter Biomedical, Inc., San Diego, Calif.

[21] Appl. No.: 205,554

[22] Filed: Jun. 7, 1988

Related U.S. Application Data

[63] Continuation of Ser. No. 925,473, Oct. 31, 1986, abandoned, which is a continuation of Ser. No. 693,911, Jan. 23, 1985, abandoned.

[51] Int. Cl.[4] ..... A61H 1/02

[52] U.S. Cl. ..... 128/25 R

[58] Field of Search ..... 128/25 R, 25 B, 24 R, 128/80 R, 80 C, 80 F, 84 R

[56] References Cited

U.S. PATENT DOCUMENTS

| | | | |
|---|---|---|---|
| 2,696,206 | 12/1954 | Bierman . | |
| 4,323,060 | 4/1982 | Pecheux | 128/84 R |
| 4,492,222 | 1/1985 | Hajianpour | 128/25 R |
| 4,493,316 | 1/1985 | Reed et al. | 128/80 C |
| 4,509,509 | 4/1985 | Bouvet et al. | 128/25 R |
| 4,524,764 | 6/1985 | Miller et al. | 128/80 C |
| 4,549,534 | 10/1985 | Zagorski et al. | 128/25 R |
| 4,558,692 | 12/1985 | Greiner | 128/25 R |
| 4,566,440 | 1/1986 | Berner et al. | 128/25 R |
| 4,621,620 | 11/1986 | Anderson | 128/25 R |
| 4,665,899 | 5/1987 | Farris et al. | 128/25 R |

*Primary Examiner*—Richard J. Apley
*Assistant Examiner*—J. Welsh
*Attorney, Agent, or Firm*—Flehr, Hohbach, Test, Albritton & Herbert

[57] ABSTRACT

A continuous passive motion device comprises a base and femoral and tibial supports which rotate about a first pivot point located at the knee, the femoral support also rotating about a pivot point which comprises an extension of the base and is located adjacent the patient's hip. The motor is located in the base beyond the end of the travel of drive rods which extend from the base to the tibial support. The motor drives the foot of these rods forward and backward along the base. The drive rods move from a nearly horizontal positon relative to the base up to a vertical positon and past this vertical position. A camming mechanism is provided coupling the upper end of the drive rods to the tibial support, the camming mechanism being engaged when the drive rods are nearly vertical, to provide additional rotational force to the tibial support which is conveyed to the knee joint. In this way, a powerful bending force is conveyed to the knee, to thereby provide the necessary rehabilitating force to the knee joint. A specially designed hinge to provided at the joint between the femoral and tibial support to mimic the motion of the knee joint to make the use of this device more comfortable. A footplate is provided attached to the end of the tibial support and is connected by a short ankle rotation drive rod to a slot in a slider bar running parallel to the driver rods. In this way, the rotational motion of the foot support plate is caused directly by movement of the drive bars; this rotational motion can be adjusted depending on the point in the slot at which the adjustable drive rod is fastened. Special patient support pads are provided to be removably attached to the foot support plate, tibial and femoral supports; use of these pads allows for adjustment of the position in which a patient's leg rests on the leg support.

18 Claims, 6 Drawing Sheets

CONTINUOUS PASSIVE MOTION DEVICE

This is a continuation of application Ser. No. 925,473, filed Oct. 31, 1986, now abandoned, which is a continuation of application Ser. No. 693,911 filed Jan. 23, 1985, now abandoned.

BACKGROUND OF THE INVENTION

This invention relates generally to medical rehabilitation devices and more particularly to a continuous passive motion device used for orthopedic treatment of lower limbs.

Since the time of earliest medicine, the overwhelmingly predominant tradition of the management of injured joints has been immobilization. This tradition, even though almost exclusively practiced, has not been without controversy. As early as the 1900's, it was found that a greater range of motion could be achieved if efficient movement of injured joints was immediately instituted after a correcting operation. Currently, a form of motion treatment is being applied in a number of areas, especially for people with recent knee operations. An example of the type of apparatus used in such rehabilitation is U.S. Pat. No. 4,323,060. This patent disclosed a motorized splint structure which supports the femoral and tibial section of the leg by two articulated supports. The femoral and tibial supports rotate relative to one another and move relative to the base by a motor which connects the femoral and tibial supports. In this way, motion is applied to the knee joint. However, a study of the device shown in this patent and other devices shown or known in the prior art has uncovered a number of deficiencies.

SUMMARY OF THE INVENTION

It is an objective of the present invention to provide an improved CPM (continuous passive motion) rehabilitation device.

One of the deficiencies with known CPM systems is that the driving force is not efficiently applied to the joint undergoing rehabilitation. It is an objective of the present invention to apply the driving force more efficiently and directly to the joint undergoing rehabilitation.

Another deficiency of the prior art is that problems can arise with extended use of the CPM device on a single leg. In the ideal rehabilitation setting, it would not be unusual to apply the rehabilitating driving force for eight to 10 hours at a time. An advantage of the design disclosed herein is that the force applied to the knee joint and with which the joint is being bent can be closely regulated.

Another objective of the present invention is to provide a suitable joint between the tibial (calf) and femoral (thigh) supports which replicates the unusual joint of the knee so that no undue stress is applied to the knee joint.

Another objective of the present invention is to provide a means for so driving the support that the major force applied to the knee joint is a bending force rather than a compacting force such as typically occurs with devices of the type known in the prior art.

A further objective of the present invention is to provide a device whose framework includes a simplified hinge system which can be easily adjusted to accommodate legs of different lengths.

In many uses of CPM devices, it is desirable to provide some rotation movement of the ankle; alternatively, in other uses, it may be desired to hold the ankle fixed. In devices of the type used in the prior art, the device which supports the foot has been typically rotated by a rod extending to the knee joint, making it extremely difficult to adjust to meet the needs of different patients.

It is an objective of the present invention to provide a novel device for rotating the foot plate of the CPM device (the orthosis) and thereby the ankle of the patient whose leg is resting on the orthosis.

Another objective of the present invention is to provide a proper alignment of all the moving splits of the orthosis with the limbs undergoing rehabilitation. Specifically, devices of the prior art typically have not been properly aligned with the femoral and tibial leg sections, providing an uncomfortable experience for the patient undergoing treatment.

It is an objective of the present invention to provide a continuous passive motion device for the lower limb which is aligned with the leg by providing a base and easily uncoupled base extension which aligns the pivot point for the femoral support with the hip joint, so that the rotation of the femoral portion of the leg is directly about the hip joint.

Yet another objective is to provide extensible sections in the orthosis so that the weight of the patient is evenly distributed on the device.

A further objective of the present invention is to provide for a more comfortable experience for the user of the device by providing a system of pads which have accompanying straps, the straps cooperating with the framework of the orthosis so that legs of different weights and muscle structure can be comfortably accommodated.

Another advantage of the present invention is that it is microprocessor controlled, thereby making it easier to establish the parameters of the desired treatment.

Specifically, two advantageous modes of rehabilitation have been developed for use with this machine. One, neuromuscular stimulation, is used simultaneously with the movement of the injured limb by the CPM device. In another mode, a complete relatively long term treatment cycle is programmed into the machine.

Another objective of the present invention is to provide means for monitoring the status of the patient's treatment. This can be achieved by coupling appropriate sensors to portions of the orthosis, and taking readings at predetermined times from the sensors to monitor the progress of the patient. The sensors are usable either while the orthosis is operating or not.

The above objectives and advantages of the present invention are achieved by a device comprising a base, and femoral and tibial supports which rotate about a first pivot point located at the knee, the femoral support also rotating about a pivot point which comprises an extension of the base and is located adjacent the patient's hip. The motor is located in the base beyond the end of the travel of the drive rods which extend from the base to the tibial support, the motor drives the foot of these rods forward and backward along the base. The drive rods move from a nearly horizontal position relative to the base up to a vertical position and past this vertical position. A camming mechanism is provided coupling the upper end of the drive rods to the tibial support, the camming mechanism being engaged when the drive rods are nearly vertical, to provide additional rotational force to the tibial support which is conveyed to the knee joint. In this way, a powerful bending force is conveyed to the knee, to thereby provide the necessary rehabilitating force to the knee joint.

A specially designed hinge is provided at the joint between the femoral and tibial support to mimic the motion of the knee joint to make the use of this device more comfortable.

A footplate is provided attached to the end of the tibial support and is connected by a short ankle rotation drive rod to a slot in a slider bar running parallel to the drive rods. In this way, the rotational motion of the foot support plate is caused directly by the movement of the drive bars; this rotational motion can be adjusted depending on the point in the slot at which the adjustable drive rod is fastened.

Special patient support pads are provided to be removably attached to the foot support plate, tibial and femoral supports; use of these pads allows for adjustment of the position in which a patient's leg rests on the leg support.

The objectives and advantages of the present invention will be more fully understood by the detailed description to follow which is given with reference to the accompanying drawings in which:

DETAILED DESCRIPTION

Figure 1:
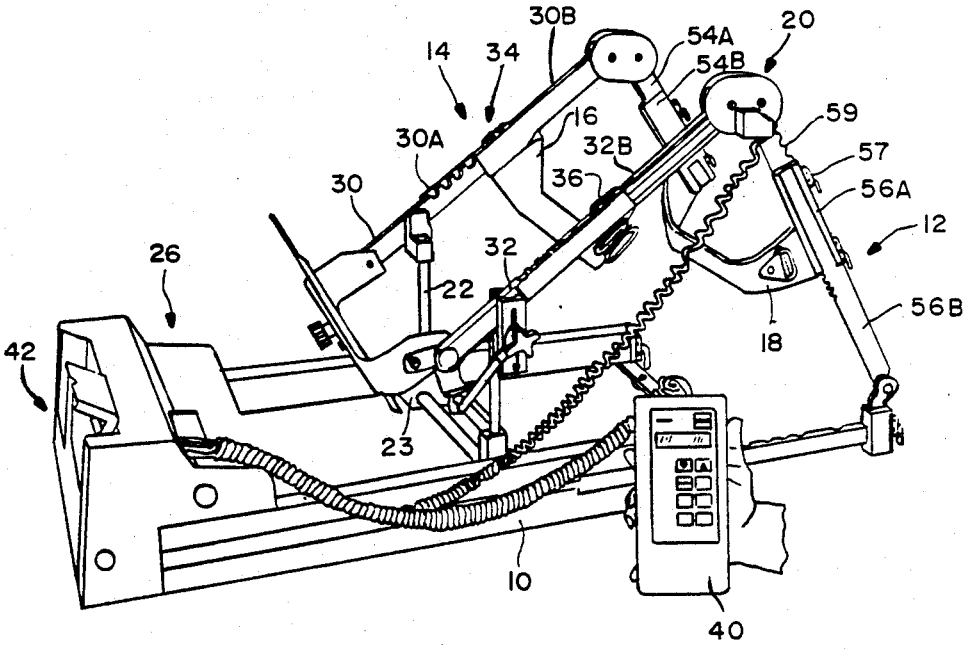
FIG. 1 comprises a perspective view of the continuous passive motion device of the present invention.

Referring to FIG. 1, this shows a continuous passive motion device according to the present invention comprising a base 10 a femoral section indicated generally at 12 and a tibial support section indicated generally at 14. The femoral and tibial support sections each include metal support cradles 16, 18 primarily for structural support. As will be discussed in further detail with respect to the showing in FIG. 7, for added patient comfort and in order to adjust the orthosis to accept individual legs, custom designed, padded supports are provided to be strapped in place on the framework of the orthosis. These padded support pads have adjustable straps on the back for fastening the strap to the orthosis. The manner in which the pads are used to position the leg in the orthosis significantly changes the strain on the patient's ligaments and muscles, as discussed further below.

Figure 1B:
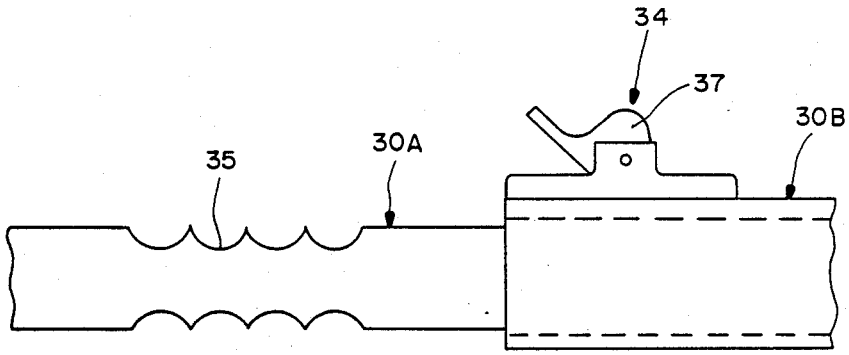
FIG. 1B shows a detailed view of the notch and cam arrangement of FIG. 1.
Figure 1C:
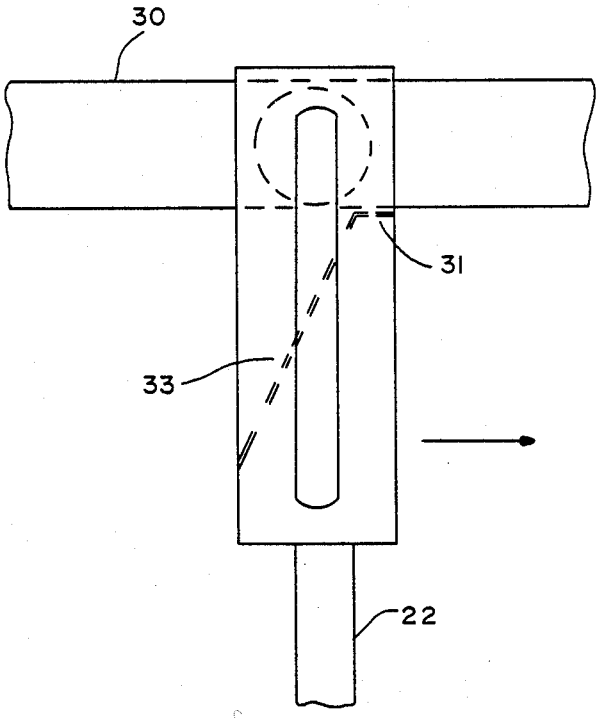
FIG. 1C shows a detailed view of a cam engaged between a drive arm and tibial support.
Figure 6:
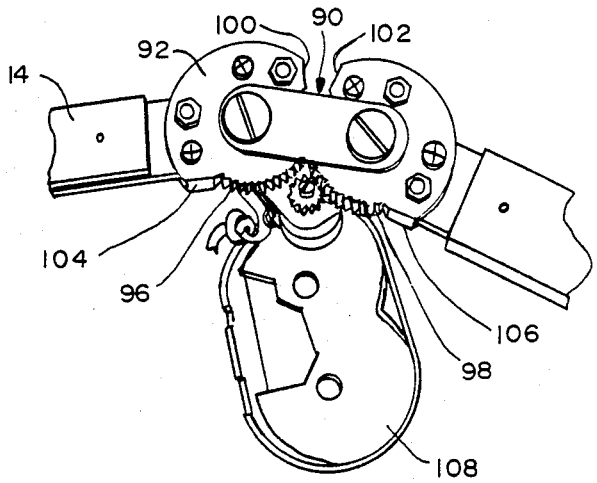
FIG. 6 shows details of the gear which connects the tibial and femoral supports.

The tibial and femoral supports 12, 14 are pivoted at a knee pivot 20, details of which are discussed with respect to FIG. 6. Drive arms 22, 24 are provided which are moved by means of a chain drive coupled to a motor within the housing 26 (see FIG. 8); the feet 23, 25 of the drive arms 22, 24 move from a position nearly at the rear or left of the base 10 to a position nearly at the front of the base. Thus the drive arms 22, 24 are lying much closer to the horizontal when they are near the rear of the base 10; the drive arms move to a point which is nearly vertical and at this point is approximately perpendicular with respect to the tibial support. At this point, a cam, shown in detail in FIG. 1C, engages between the drive arm 22, 24 and the arms of the tibial support 30, 32. This cam comprises a flat surface 31 and inclined surface 33. When the drive arms are at the rear of the base, the calf support 30 rests on incline 33. As the drive arms are moved forward, they rotate relative to calf support 30 until support 30 meets cam surface 31. This cam, which operates through a rotation of about 20 degrees, firmly engages the tibial support to transmit the moving force of the drive arms 22, 24 to the knee joint 20. This added power is provided to "break" the knee joint so that as the movement of the feet of the drive arms 22, 24 down the base continues, the proper rotation of the knee about the joint 20 will occur.

It is important to note that each of the calf and thigh supports 30, 32 comprise two sections 30A, B and 32A, B. These sections slide one inside the other (see FIG. 1B), and are latched in place using latches 34, 36, so that the length of this portion of the orthosis may be adjusted to comfortably fit the leg of the user. The notches 35 which each of the locks fits inside appear clearly in the top of the sliding bar; the cam portion 37 on the latch 34 can then be rotated by handle 38 to fit the semicircular retainer cam 37 into the appropriate notch.

The remaining elements of the device are the controller 40 and the motor and controlling microprocessor contained in housing 42. The programming of the microprocessor is of course well within the skill of the art; the necessary functions it will provide in exercising a joint undergoing rehabilitation will be discussed as necessary below.

Figure 2:
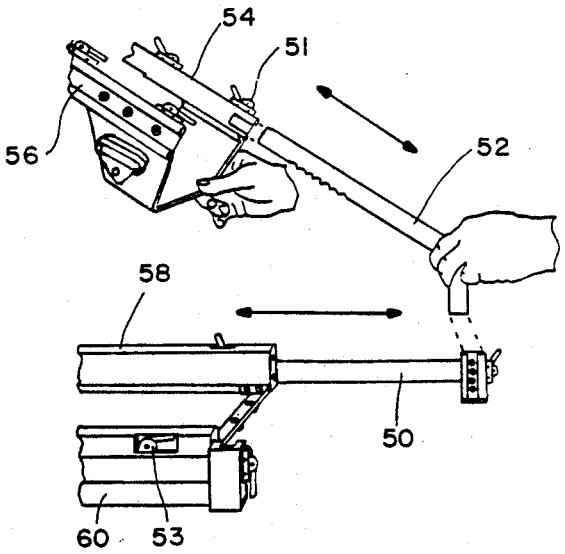
FIGS. 2 and 3 are sectional views of the right-hand portion of the invention showing the latches which are used to fix the adjustable length calf and thigh support members in place and the method of moving the hip extension bar from one side of the orthosis to the other.
Figure 3:
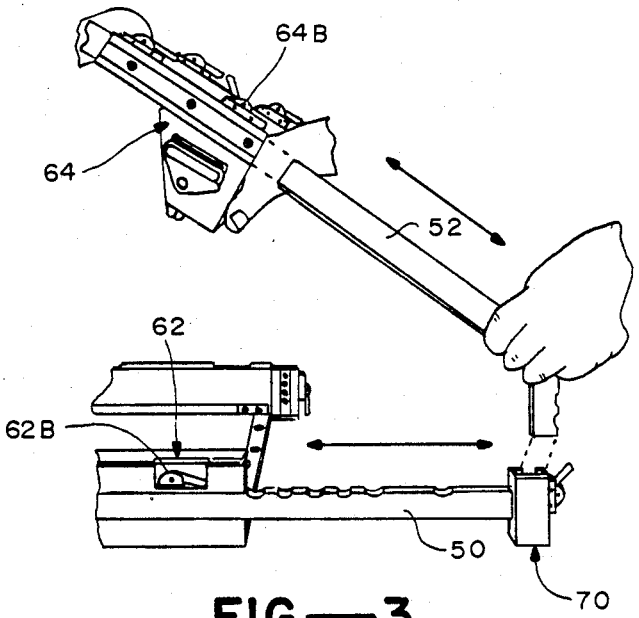
Figure 4:
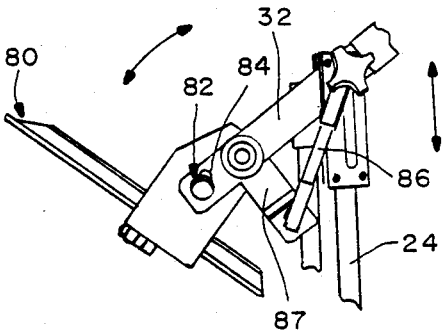
FIGS. 4 and 5 show the relationship between the drive rods to the tibial support and the adjustable connecting link to the rotating foot support.
Figure 5:
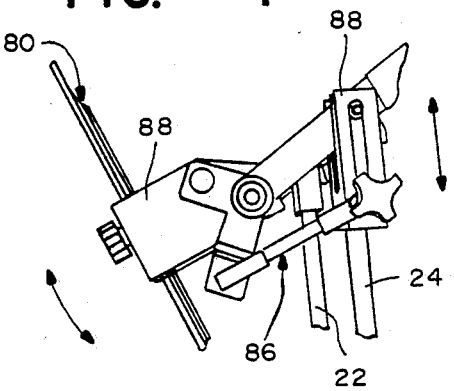

Referring to FIGS. 2 and 3, these figures more clearly show how the orthosis may be modified to be used with either leg of a patient. Specifically, the base extension rod 50 and femoral coupling rod 52 both can slide completely out of the mating piece of framework 54 or 56 and out of the appropriate base member 58, 60. These pieces may be moved to either side of the orthosis, so they lie outside the hip of the wearer. Notches are provided in the top and bottom portion of each of the two movable rods 50, 52, so that upon movement of the latches 62, 64 rotation of the cam portion 64B of the latch will seat that portion of the latch firmly within a notch of the bar. In this way, the length of the femoral section may be extended so that the base point 70 is approximately even with the hip of the patient and is of the proper length to comfortably carry the patient's leg. Details of this notch and cam arrangement appear clearly in FIG. 1B.

As discussed in general above, the end of the tibial support carries a foot support plate 80. Rotation of a knob 82 which rests in a short slot 84 allows for some movement of the footplate 80 to comfortably seat the patient's foot against it and hold it in place. In many situations, it will be desirable to cause the ankle to rotate while the leg is being exercised. In previous devices, this was extremely difficult to arrange, and was typically achieved by extending a bar from a point near the knee joint out to the foot support, making extensible adjustment of the tibial support extremely difficult and complex. Therefore, the ankle adjustment rod 86 is provided in the present invention, coupled between a plate 87 which is carried by the drive rods 22, 24 and an extension of the brace 88 for the foot support plate.

When the extension rod 86 is all the way at the top of the slot, it can be seen that a triangle is formed between the tibial support 32, the adjustable extension 86, and the extended portion 87 of the foot support brace. Thus, no rotation of the footplate 80 or the patient's foot about his ankle occurs.

If the adjustable arm 86 is moved further down the slot, more rotation of the foot support plate 80 occurs with each movement of the drive rods 22, 24 resulting in the ability to provide varying degrees of rotation of the ankle with movement of the drive rods and corresponding movement of the patient's leg.

In a further improvement over known prior art devices, an improved gearing is provided to couple the tibial and femoral supports 14, 12 at the knee. This gear 90 which comprises two semicircular portions 92, 94 having mated toothed edges 96, 98 allows for a rotation of the femoral and tibial supports 12, 14 about a joint which more nearly mimics the polycentric hinge-like motion of a true knee joint and provides a much improved flexion of the knee at the knee joint. It can be seen that the rotation of the polycentric hinge 90 can have defined limits due to the mating surfaces 100, 102, 104, 106 which come into contact at either end of movement of these two support portions. A cover portion 108 is provided to prevent or limit any damage to this gearing structure.

Figure 8:
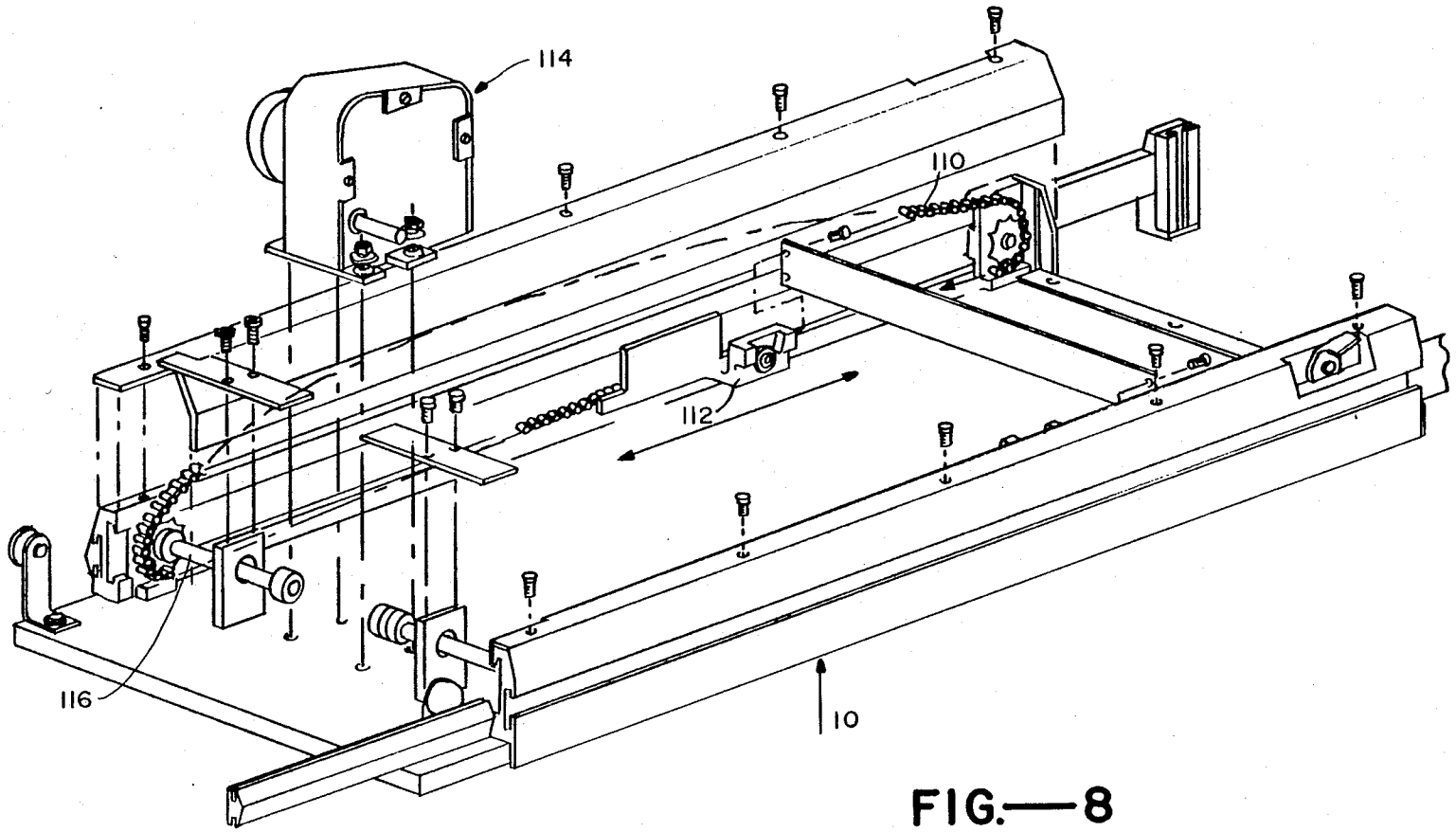
FIG. 8 is an exploded view of the base of the device showing especially the drive coupling to the drive rods.

The mechanical structure of the base is shown in further detail in FIG. 8. This figure is especially provided to show the mechanical relationship of the parts, including the movable portions of the base 10, the way in which the movable portions slide on tracks cut within the base portion, and the chain drive 110 which couples through a plastic coupling mechanism 112 to the drive rods 22, 24 to move the ends of these rods back and forth along the base as powered by the motor 114 through drive rod 116.

The following describes the recommended procedure to achieve proper anatomical alignment of the orthosis for each patient;

1. Place the device on the bed in position of mild abduction;
2. Plug the power cord into electrical outlet and switch power on.
3. Measure the following patient parameters: (a) leg length--greater trochanter (hip pivot) to the ankle; (b) thigh length--greater trochanter to knee axis of rotation; (c) calf length--knee axis to ankle (leg length minus the thigh length). Note: the above dimensions are to the nearest half inch.
4. Insert hip bar 50 to the correct side of the device 10 depending on which leg is undergoing therapy.
5. Release hip bar and the hip extension latches 51, 53.
6. Adjust the hip extension 52 to correspond to the measured leg length. The dimension marks on the hip extension must be in line with the edge of the device. (29 to 39 inches in ½-inch increments). Lock down the hip extension latch 51, making sure the latch travels smoothly into a notch.
7. Release the calf cradle latches 34, 36 and adjust the calf extension bar to correspond with the calf length. Lock down the calf cradle latches making sure that both calf extension bars are equally aligned. (13 to 18 inches in ½-inch increments).
8. Adjust the hip bar 50 to correspond to the measured hip length. The hip bar 50 may be adjusted from 14 to 17 inches in ½-inch increments. Additional length adjustment is made with the knee extension bar. Lock down the hip bar latch 53.
9. Release the thigh cradle latches and adjust the knee extension bar 59 so that the sum of the knee extension bar and the hip bar is equal to the measured thigh length. Knee extension adjustment ranges from 0 to 13 inches in ½-inch increments.
10. Turn the system power on.
11. With the program interlock key properly engaged, press the "auto/man" button. Manually run the device via the up/down arrows and verify that the range of motion is achieved.
12. Release the hip pivot latch and adjust the to maximize comfort. Upper notch if patient is lying on a firm pad or mattress; lower notch if patient is lying on soft mattress. Caution: Do not try to force latches closed. There are specific notices on each of the sliding pieces at which the latches will easily secure.

The support pieces or padded straps for cushioning the user on the frame are installed individually and may be adjusted separately. These straps provide for more than patient comfort. Proper placement and alignment reduces ligament strain for the patient.

Figure 7A:
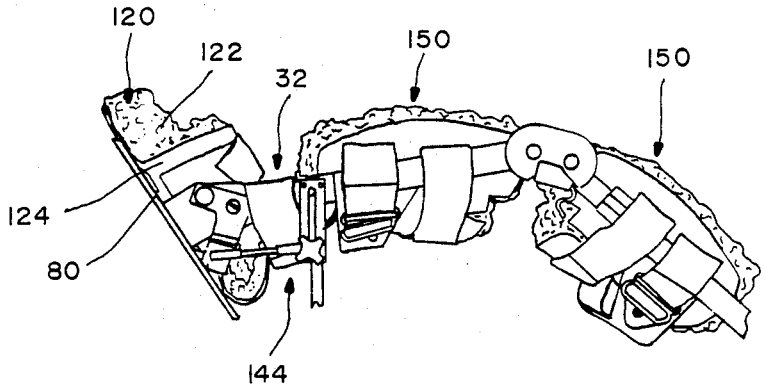
FIG. 7A–E shows the padded supports for the patient's leg as they are fastened in place on the orthosis.
Figure 7D:
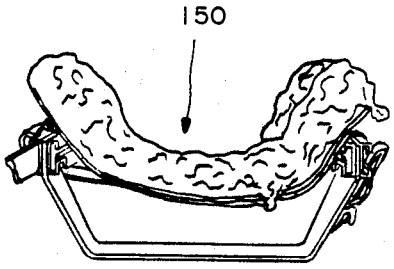
Figure 7E:
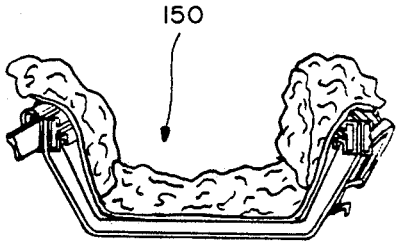
Figure 7B:
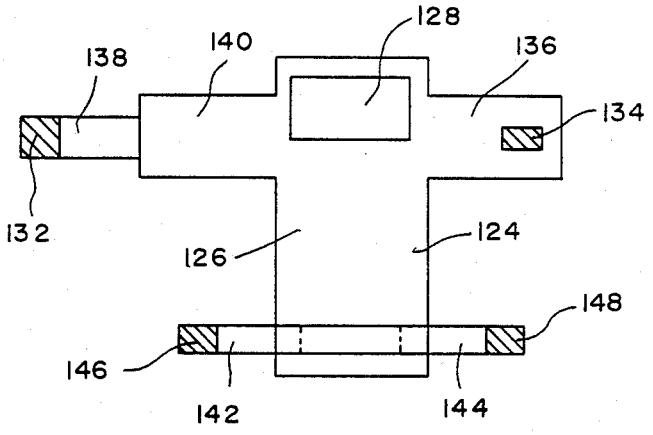
Figure 7C:
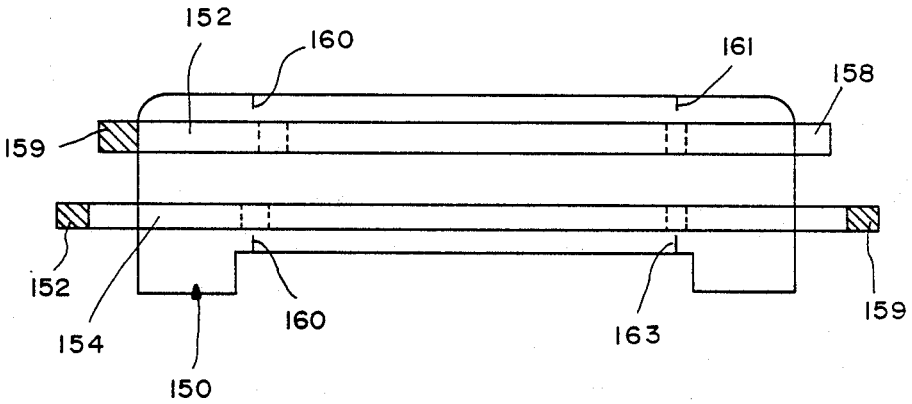

The placement of the padded straps on the orthosis is shown in FIGS. 7A, 7B, 7C, 7D. FIG. 7A shows the foot support strap 120 in place, fastened to the foot support plate 80 and the lower portion 32 of the frame. This strap is shown in detail in FIG. 7B and consists of a padded front portion 122 on a leather or similar backing 124. The major portion 126 of the support strap includes a pocket 128 which fits over the top of the foot support plate to hold it in place. VELCRO or hook loop type fasteners 132, 134 one zone directly to one of the wings of this strap 136, and the other carried on a separate strap 138 fastened to the other wing of the padded strap 140 fasten over the top of the patient's foot to hold it in place. At the bottom of the major portion 126 a second pair of hook and loop type straps 142, 144 are provided which pass underneath this extended portion of the tibial support frame to fix this portion of the strap firmly in place. The hook and loop type attaching portions 146, 148 are of sufficient length so that they can overlap at several different points so that the straps may be fastened either tightly or loosely beneath the frame of the orthosis effectively raising and lowering the padded strap and thereby the ankle of the user. In similar fashion, two leg support straps 150 are provided. They are fastened on the femoral and tibial support portions of the frame in a matching fashion. Fastening straps 152, 154 are provided with hook and loop type fasteners 156, 157, 158 and 159 at each end for fastening the padded strap to the orthosis frame. An inspection of FIG. 7C shows that this is a bottom view of the strap. The padded portion of the strap is facing into the page. Slits 160, 161, 162 and 163 are provided to allow the padded strap to be fit down against the metal cradles 16, 18 of the orthosis. The straps are then attached down underneath the orthosis to keep the padded straps from sliding. Since the fastening straps are fastened to the back of the padded strap and run horizontally across the back, pulling them tighter underneath the orthosis frame will have the effect of raising the padded strap up off the supporting metal cradle. Once the padded straps are arranged on the orthosis, the exercise program can begin. The straps on each piece allows for vertical and independent adjustment as described above. For example, for ACL (Anterior Cruciate Ligament) repair it is advantageous to provide more support by the ankle and thigh sections and less support by the calf section. PCL (Posterior Cruciate Ligament) repair requires the opposite support. Proper alignment of these padded straps will significantly reduce ligament strain.

The calf and thigh sections are identical. They are installed as mirror image of each other with the rectangular ears directed toward to anatomical knee hinge.

Several advantages also follow from the programmable nature of the system. For one, it is possible to use electronic muscle stimulation in combination with the CPM device. By attaching two surface electrodes to the area of the damaged muscle (this is done in accordance with known techniques, the electrodes essentially being secured by bandaid-like attachments) the stimulation of the muscle can be coordinated with the movement of the CPM device.

A warm-up period can also be provided. A patient's muscles stiffen up when off the machine. Therefore, the programmed force and range of motion is automatically reduced somewhat when exercise is restarted after a rest period.

What is claimed is:

1. A continuous passive motion device for exercising a lower limb comprising a base, a thigh support pivotally coupled at one end to one end of the base, a calf support pivotally coupled at one end to the other end of the thigh support, a foot support mounted on the other end of said calf support, drive arms extending up from the base to pivotally connect to the thigh support to support the calf support above the base, the lower end of the drive arms being connected to the drive means and movable linearly along the base to produce relative angular movement between the calf and thigh support, and means coupling the foot support to said drive arms for rotating said foot support relative to said calf support in response to movement of said drive arms.

2. A device as in claim 1 including a pivotal connection between the foot support and the calf support, and an extension rod connecting the foot support and the drive arm, one end of said extension rod being slidable along the drive arm from a first position adjacent the calf support where no rotation of the foot support relative to the calf support occurs to positions along the drive arm spaced from said calf support where varying degrees of rotation of said foot support relative to said calf support occur with movement of said drive arm.

3. A device as in claim 2, wherein said drive arm has a slot extending from said calf support along the drive arm, an end of said rod being positionable in the slot to fix the rotation of said foot support.

4. A device as in claim 3 including an extended portion mounted on and extending away from said foot support, said rod connecting said portion at a point away from the plane of the calf support to said drive arm so that the link may effectively rotate the foot support about the pivotal connection.

5. A continuous passive motion device for the exercise of a patient's leg comprising a base, power means comprising a motor mounted on said base, means comprising a first pair of parallel support arms for supporting the femur of the patient's leg, and femur supporting means having one end connected to said base, means comprising a second pair of parallel support arms for supporting the tibia of the patient's leg, said tibia support means being hingedly connected to the femur support means and supported from said base, means coupling said first and second pair of arms at said patient's knee for relative rotation, means for supporting the foot of said leg carried at one end of said tibia support means, means coupling said motor to said tibia support means for causing relative rotation of said tibia and femur supporting means, comprising a pair of drive arms having upper ends connected to said tibia support means and lower ends movable linearly along said base to cause relative rotation of said tibia and femur supporting means and thereby rotation of said knee, and means coupled to said drive arms for rotating said foot supporting means relative to said tibia supporting means with movement of said drive arms.

6. A continuous passive motion device as in claim 5 wherein said foot supporting means comprises a pair of arms extending said tibia support means, and a sole support plate for supporting the bottom of a patient's foot mounted substantially at right angles to said foot support arms.

7. A continuous passive motion device as in claim 5 including an extension rod extending from said drive arm to said foot support to control said rotational movement of said support with movement of said drive arm.

8. A continuous passive motion device as in claim 7 wherein one of said drive arms has a slot in one side, one end of said extension rod carrying a bolt slidable in said slot, the position of said bolt in said slot varying the rotation of said foot support means caused by said drive arm.

9. A continuous passive motion device as in claim 7 wherein said drive arms rotate relative to said foot support, one of said drive arms being coupled to said foot support through said extension rod.

10. A continuous passive motion device as in claim 9 wherein each one of said drive arms is coupled to an arm of said tibia support means, one of said drive arms having a slot in one side extending from a point adjacent said tibia support down said drive arm toward said base, one end of said extension rod carrying a bolt slidable in said slot to vary the rotation of said foot support as a function of the position of the bolt in said slot.

11. A continuous passive motion device as in claim 10 including a bar extending down from said foot support, said extension rod being coupled from said bar to said slot to rotate said extremity foot support.

12. A continuous passive motion device for a patient's lower limb comprising a base, means connected to the base for supporting the thigh portion of the lower limb, means for supporting the calf portion of the lower limb, means for hingedly connecting the calf support means and the thigh support means for rotation of said calf and thigh support relative to one another about said hinged connection, drive means mounted on the base for causing the relative rotation, drive arms connected to said drive means and extending from said base to said calf support to support said calf support above said base, said drive arms having a first end slidable in said base and a second end connected to said calf support near and end of said calf support distal from said hinge means, movement of said drive arms created by said sliding movement of said first end in said base causing said relative motion of said calf and thigh support, said thigh support comprising a telescoping rod extending one arm of said thigh support to said base, said base comprising a pair of arms extending under said calf support, at least one of said arms accepting a telescoping base extension rod at the end nearest the patient's hip, said base extension rod being adjustable to extend to a point near a patient's hip to connect to said telescoping rod extending said thigh support to said base at said point adjacent said patient's hip and connecting means in the end of said base extension rod for coupling said base extension rod to said thigh support telescoping rod to physically establish a device support rotation point adjacent to said patient's hip adjustable to fit the physical structure of the patient undergoing therapy, said drive means comprising a motor coupled to said drive arms, the top portions of the drive arms being coupled to a point on the calf support which overlies a given point on the base, the foot portion of the drive arms being coupled to the motor and moved from a point on the base rearward of the given point to a point on the base forward of the given point to cause said relative rotation of said calf and thigh supports, and cam means coupling said top portions of said drive arms and said calf support, said cam means engaging said calf support when said drive arms are nearly perpendicular relative to said calf support and transmitting further moving force of the drive arms directly to said knee joint.

13. A device as in claim 12 wherein said cam means comprise an element carried on one of said drive arms having a surface rotating in the plane of an arm of said calf support, said surface of said element cooperating with the arm of the calf support to directly convey the motion of said drive arm to said calf support to cause rotation of the drive arm about the hinge between the calf support and thigh support to convey a powerful bending force to the knee to rehabilitate the knee of the user.

14. A device as in claim 12 wherein each of said calf support and thigh support comprises a pair of telescoping arms for separately adjusting the length of each support.

15. A device as in claim 14 wherein each of said arms comprise a pair of telescoping elements coupled by a latch mechanism comprising a series of notches on an inner sliding element and a cam carried on the outer sliding element rotatable by a latch into one of said notches.

16. A continuous passive motion device for exercising a patient's lower limb comprising a base, drive means comprising a motor mounted on said base, a thigh support pivotally coupled at one end to one end of the base, a calf support having one end pivotally coupled at a point adjacent the patient's knee joint to the other end of the thigh support, said thigh support and said calf support each comprising a pair of longitudinally extending arms articulated for relative rotation, drive arms being connected to the arms of said calf support, one of said thigh support arms being connected to said base and having an end aligned adjacent the hip of said patient, said calf and thigh support overlying a portion of said base, said drive arms extending up from the base to pivotally connect to the calf support arms to support the calf support above the base, the foot end of the drive arms being connected to the drive means and movable along the base alternately toward and away from the hip of the patient to produce relative angular movement between the calf and thigh support, and cam means coupling said drive arms and said calf support said cam means engaging said drive arms and calf support for rotating said calf support relative to said thigh support and for conveying force from said drive means to the patient's knee joint to effectively break the knee joint during exercise of said limb.

17. A device as in claim 16 wherein each of said calf support and thigh support comprises a pair of telescoping arms for separately adjusting the length of each support.

18. A device as in claim 17 wherein said base comprises a pair of arms each accepting a telescoping extension element at the end nearest the patient's hip, said base extension element being adjustable so as to extend to a point near a patient's hip.

* * * * *